United States Patent [19]

Matumoto et al.

[11] 4,311,451

[45] Jan. 19, 1982

[54] BURNER

[75] Inventors: Michiaki Matumoto, Tokyo; Sadao Mimori, Yoshikawamachi, both of Japan

[73] Assignee: Hitachi, Ltd., Tokyo, Japan

[21] Appl. No.: 942,030

[22] Filed: Sep. 13, 1978

[30] Foreign Application Priority Data

Sep. 13, 1977 [JP] Japan ..... 52-110260
Sep. 13, 1977 [JP] Japan ..... 52-110261

[51] Int. Cl.[3] ..... F23D 13/40; F23N 1/00
[52] U.S. Cl. ..... 431/352
[58] Field of Search ..... 431/352

[56] References Cited

U.S. PATENT DOCUMENTS

| | | | |
|---|---|---|---|
| 2,692,014 | 10/1954 | MacCracken | 431/352 |
| 2,918,118 | 12/1959 | Schirmer | 431/352 |
| 3,593,518 | 7/1971 | Gerrard | 431/352 |
| 3,898,797 | 8/1975 | Wood | 431/352 |
| 4,054,028 | 10/1977 | Kawajuchi | 431/352 |

FOREIGN PATENT DOCUMENTS

| | | | |
|---|---|---|---|
| 1444673 | 8/1975 | United Kingdom | 431/352 |

*Primary Examiner*—George E. Lowrance
*Attorney, Agent, or Firm*—Craig and Antonelli

[57] ABSTRACT

A burner having main air ports for issuing a secondary air at a relatively high flow velocity, and auxiliary air ports for issuing a secondary air at a relatively low flow velocity located upstream of the main air ports with respect to a stream of a gaseous fuel or a preformed mixture of fuel and primary air in which the fuel is enriched over and above a flammability limit. The secondary air issuing from auxiliary air ports may have its flow velocity reduced by utilizing speed reducting compartments formed in a combustion chamber or recesses formed in walls of the combustion chamber. Flame stabilizing plates may be provided near the auxiliary air ports to extend substantially perpendicularly to the stream of the gaseous fuel or the preformed mixture of fuel and primary air. The main air ports may be in the form of a plurality of slits formed continuously in side-by-side relation in a secondary air passage located in the middle of and along a passage for the gaseous fuel or the preformed mixture of fuel and primary air. The slits each have an upper end portion in the form of an arc or an arcuate polygon at the inner surface. The secondary air passage may be formed on its upstream side with increased thickness portions in which slits are formed and contiguous with the secondary air issuing slits. The passage for the gaseous fuel or the preformed mixture of fuel and primary air may be formed with offset portions to widen the passage.

13 Claims, 17 Drawing Figures

BURNER

BACKGROUND OF THE INVENTION

1. Field of the Invention

This invention relates to a burner for burning a gaseous fuel which is low in combustion noise and high in combustion load and which has a relatively high thermal output, and, more particularly, to a burner of the type described which can have application in domestic combustion equipment.

2. Description of the Prior Art

A Bunsen burner is one type of burner of low combustion noise which burns a fuel-air mixture formed beforehand by mixing a fuel with a primary air in a flammable range. This type of burner has had wide application as domestic burner, because it is low in combustion noise and the preformed fuel-air mixture for combustion has a concentration which is in a flammable range and amenable to combustion. However, this type of burner has disadvantages in that it has a low combustion load and it is large in size.

Taking note of the fact that this type of burner is low in combustion noise, we have conducted research into high load combustion with this type of burner, and have discovered that the objects of reducing a noise and increasing a load during combustion can be accomplished by supplying secondary air in the form of a turbulent flow to an outer flame formed in a trailing portion of an inner flame which is in the form of a laminar flow. Based on this discovery, an invention has been developed which is disclosed in U.S. Ser. No. 771,912 filed on Feb. 25, 1977 (which corresponds to Japanese Laid-Open Patent Application No. 105335/77 dated Sept. 3, 1977). However, it has since been ascertained that this burner is not suitable for domestic use because combustion oscillation produced during combustion when the amount of heat produced by combustion reaches ten thousand odd kcal/h.

SUMMARY OF THE INVENTION

This invention has as its object the provision of a burner of low combustion noise and high combustion load, which burner burns a gaseous fuel in diffusion combustion or burns a preformed mixture of fuel and primary air in which the fuel is enriched over and above a flammable limit.

According to the invention, the object of providing a burner of low combustion noise and high combustion load can be accomplished by injecting a secondary air of relatively high flow velocity into a fuel or a mixture of fuel and primary air in which the fuel is enriched over and above a flammability limit.

DESCRIPTION OF THE EMBODIMENTS

Figure 1:
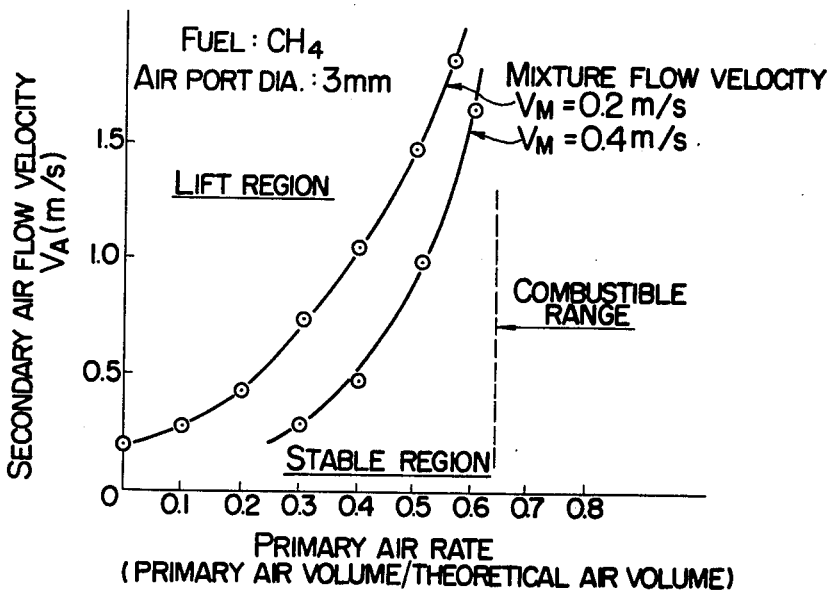
FIG. 1 is a diagram showing the stability limit of a flame adhering to the vicinity of secondary air ports when a secondary air is injected into a preformed mixture of fuel and air, in which the mixture flow velocity $V_M$ is used as a parameter and the relation between the primary air rate of the mixture and the issuing speed of the secondary air of a lift limit is shown.

A burner, which burns a gaseous fuel or a preformed mixture of fuel and air in which the fuel is enriched over and above a flammability limit, carries out combustion as a secondary air is supplied and mixed with the gaseous fuel or the preformed mixture. If the flame adhering to secondary air ports floats up, a noise will be produced. A lift limit of the flame seen at this time will be explained by referring to FIG. 1, which shows a lift limit of the flame adhering to the vicinity of the secondary air ports and blown by the secondary air issuing from the air ports of 3 mm in diameter and injected into the preformed mixture of fuel ($CH_4$) and primary air. In FIG. 1, the abscissa represents the primary air rate (primary air volume/theoretical air volume) of the preformed mixture, and the ordinate indicates the speed at which the secondary air issues from the air ports.

The diagram shows the results of tests conducted when the mixture flow velocity $V_M=0.2$ m/s and $V_M=0.4$ m/s.

When $V_M=0.2$ m/s, it has been found that the flame is relatively stable if the secondary air flow velocity is relatively low or below 0.2 to 1.5 m/s as contrasted with the primary air rate of 0 to 0.5, and that if the flow velocity becomes higher than that of the flame adhering to the secondary air ports floats up, thereby producing a noise. Also, when $CH_4$ is the fuel of the preformed mixture, it has been found that the primary air rate within the flammability limit is 0.64 if the fuel is enriched, and that the primary air rate within the flammability limit is 1.8 if the fuel is lean. Therefore, it will be seen that any preformed mixture in which the primary air rate is in the range between 0.64 and 1.8 is within a flammability limit. As the primary air rate of a preformed mixture becomes closer to 0.64 which is the combustible limit with the enriched fuel, the secondary air issuing velocity which provides a limit to the production of a lift rapidly increases. Also, if the mixture flow velocity $V_M$ is doubled to 0.4 m/s, the secondary air issuing velocity which provides a limit to the production of a lift is about one half that which prevails when $V_M=0.2$ m/s.

FIG. 1 shows the results of tests conducted with a burner in which the air ports have a diameter of 3 mm. It has been found that, if the diameter of the air ports is increased, then the secondary air issuing velocity which provides a limit to the production of a lift tends to become higher. In the tests shown in FIG. 1, the fuel used is $CH_4$. However, it has also been found that, if the fuel is the vapor of kerosene or $C_4H_{10}$, the secondary air issuing velocity which provides a limit to the production of a lift tends to become higher.

Thus, it will be understood that, if an attempt is made to obtain high load combustion by increasing the issuing velocity of the secondary air from the air ports and causing the mixing of the secondary air with the fuel or preformed mixture to take place at a higher speed, the flame will float up from the portion of the burner near the air ports, thereby increasing a combustion noise. Conversely, if an attempt is made to cause the flame to adhere to the portion of the burner near the air ports so as to reduce a combustion noise, it is necessary to delay the issuing velocity of the secondary air from air ports. Mixing of the secondary air with the fuel or preformed mixture will be thus delayed, resulting in low load combustion. Thus, there is no alternative but to select either a low noise at the sacrifice of an increased combustion load or to select a high load combustion at the sacrifice of a reduced combustion noise, or to find out a point of compromise between the conflicting demands of reducing a combustion noise and increasing a combustion load of burner.

According to the invention, air ports issuing therefrom a secondary air at a relatively low flow velocity is provided on the upstream side of air ports issuing therefrom a secondary air at a relatively high flow velocity, so that a stable flame will be formed in the air ports for issuing relatively low flow velocity secondary air to enable combustion to take place at a low noise and a high load. The invention will now be described in detail by referring to various embodiments thereof shown in the accompanying drawings.

Figure 2:
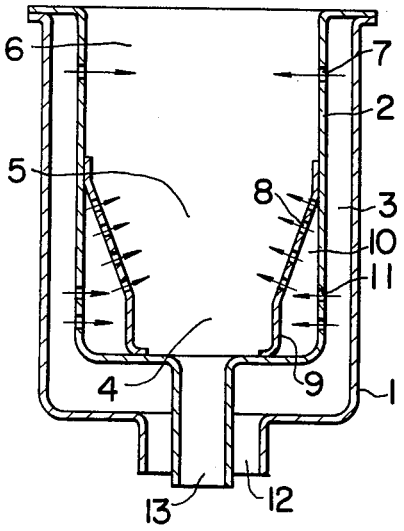
FIG. 2 is a sectional view of the burner comprising a first embodiment of the invention.

FIG. 2 shows a first embodiment in which 1 designates an air chamber having an inner box 2 inserted therein in airtight relationship, and an air passage 3 is defined between the air chamber 1 and inner box 2. Formed inside the inner box 2 are a fuel zone 4, an upper combustion zone 5 and a lower combustion zone 6 formed successively in going from the upstream side to the downstream side of the box 2. 7 designates air ports through which a secondary air enters into the inner box 2 at a relatively high flow velocity. 8 designates auxiliary air ports through which a secondary air enters into the inner box 2 at a relatively low flow velocity. 9 designates speed reducing walls defining speed reducing chambers 10, and 11 designates apertures of an area smaller than the area of the auxiliary air ports 8. 12 designates a secondary air inlet, and 13 designates a mixture inlet.

In the burner constructed as aforesaid, the vapor produced by vaporization of kerosene at the bottom of the inner box 2 is supplied to the fuel zone 4, or a mixture of a primary air and the vapor of kerosene in which the fuel is enriched above a flammability limit, a gaseous fuel or a mixture of primary air and fuel in which the fuel is enriched above a combustible limit is supplied through the mixture inlet 13 into the fuel zone 4 from a separate supply device. The gaseous fuel or fuel-primary air mixture supplied through the mixture inlet 13 will be hereinafter referred to as a mixture.

Since the mixture in the fuel zone 4 includes a fuel which is enriched above a combustible limit, the mixture does not burn in the fuel zone 4 and flows to the combustion zone 5 downstream thereof. The mixture is preferably a preformed mixture of air and fuel rather than a fuel itself. Meanwhile a secondary air supplied by a separately provided blower means, not shown, is introduced through the secondary air inlet 12 into the air chamber 1, and then flows through the apertures 11 into the speed reducing chambers 10 where the flow velocity of the secondary air is reduced, with the result that a secondary air of relatively low flow velocity is injected from the speed reducing chambers 10 into the combustion zone 5 through the auxiliary air ports 8. In the combustion zone 5, the secondary air of a relatively low flow velocity is mixed with the mixture from the fuel zone 4 and the mixture burns. Since the secondary air issuing through the secondary air ports 8 is relatively low in flow velocity, a flame is formed in such a manner that it adheres to the part of the burner near the auxiliary air ports 8, for the reason described by referring to FIG. 1. Thus the mixture burns at a low combustion noise. The mixture which partly burns in the combustion zone 5 and has its temperature increased flows into another combustion zone 6 downstream of the combustion zone 5. This mixture contains large amounts of intermediate products of combustion.

Meanwhile, part of the secondary air introduced into the air chamber 1 through the secondary air inlet 12 is injected through the air ports 7 at a relatively high flow velocity into the combustion zone 6, where such secondary air is mixed with the mixture from the combustion zone 5 and the mixture burns. Since the secondary air issuing through the air ports 7 is relatively high in flow velocity, the secondary air is rapidly mixed with the mixture and combustion takes place quickly, so that high load combustion takes place. At this time, the mixture flowing from the combustion zone 5 into the combustion zone 6 is relatively high in temperature and contains large amounts of intermediate products of combustion. Thus, even if the flow velocity of the secondary air issuing through the air ports 7 is relatively high, a flame produced stably adheres to the part of the burner near the air ports 7, so that combustion takes place at a relatively low noise.

As explained by referring to FIG. 1, the secondary air issuing velocity which provides a limit to the production of a lift suddenly becomes high when the primary air rate of the mixture becomes close to the combustible limit. In view of this result of the experiments, it is possible to form a flame in the part of the burner near the secondary air ports 7 which is further stabilized, if the volume of the secondary air issuing through the auxiliary air ports 8 into the combustion zone 5 is controlled such that the ratio of the fuel to the air is within a flammable range.

In conventional burners of the low noise type, the velocity at which a secondary air issues through air ports has been about 2 or 3 m/s, and the combustion load has been about $10^6$ kcal/h·m$^3$. In one example of the burner according to the invention, experiments were conducted by setting the primary air rate of the mixture at 0.4 to 0.6, the secondary air issuing velocity through the auxiliary air ports 8 at 0.5 to 1.5 m/s and the secondary air issuing velocity through the air ports at 5 to 15 m/s. The results of the experiments show that, even if the load applied to the combustion zone was at about $10^7$ kcal/h·m$^3$, the noise of combustion was no greater than the noise produced in conventional burners.

Figure 3:
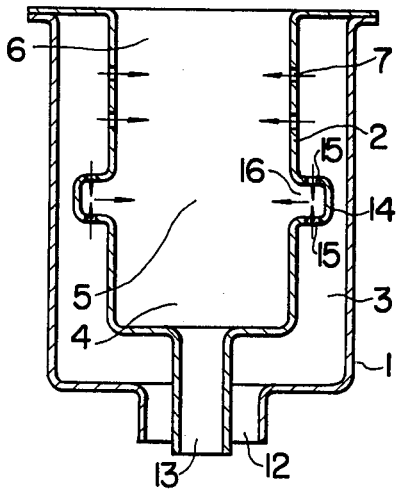
FIG. 3 is a sectional view of the burner comprising a second embodiment of the invention.

FIG. 3 shows a second embodiment of the invention, in which recesses 14 are formed in the inner box 2 and air inlet ports 15 are formed in each recess 14, so that each recess 14 will function as a speed reducing chamber. The opening of the recess 14 serves as an auxiliary air port 16. This embodiment is simple in construction and easy to fabricate, and yet it is possible to reduce the velocity of the secondary air introduced through the air inlet ports 15 into the speed reducing chamber 14, so that the secondary air will issue through the secondary air ports 16 into the combustion zone at a relatively low flow velocity.

Figure 4:
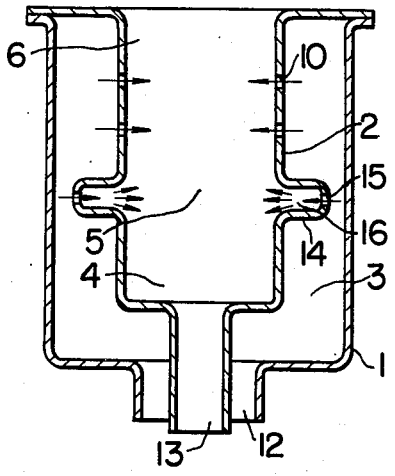
FIG. 4 is a sectional view of the burner comprising a third embodiment of the invention.

FIG. 4 shows a third embodiment of the invention which is a modification of the second embodiment. The difference between the second and third embodiments lies in the position of the air inlet ports 15 formed in the speed reducing chambers 14.

Figure 5:
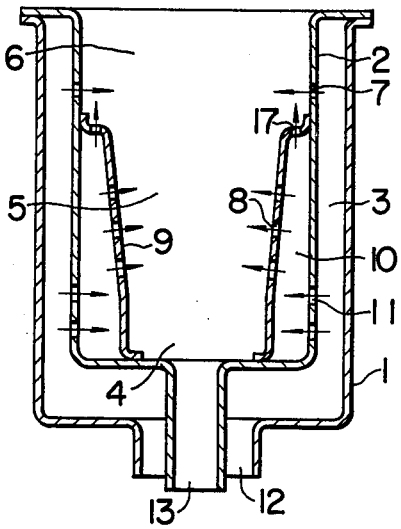
FIG. 5 is a sectional view of the burner comprising a fourth embodiment of the invention.

FIG. 5 shows a fourth embodiment of the invention in which speed reducing chamber walls 9 each include an upper substantially horizontal portion which is close to the upstream side of the secondary air ports 7, and auxiliary air ports 17 are formed in this portion of the walls 9 for issuing the secondary air of a relatively low flow velocity therethrough. A flame formed in a manner to adhere to the ports 17 is located in the vicinity of, or in contact with, the upstream side of the secondary air ports 7, so that the heat generated by the flame and the intermediate products of combustion by the flame can be supplied to the vicinity of the air ports 7. In this way, a stabilized flame can be formed in the secondary air ports 7 and the noise of combustion can be reduced.

Figure 6:
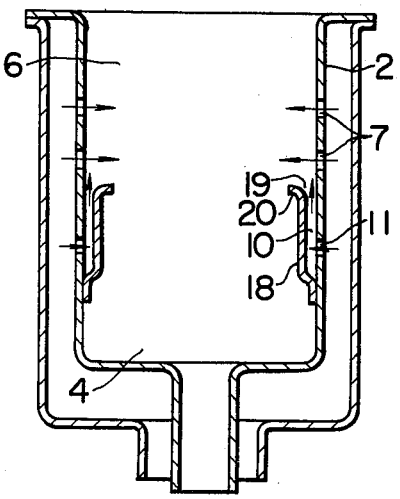
FIG. 6 is a sectional view of the burner comprising a fifth embodiment of the invention.

FIG. 6 shows a fifth embodiment of the invention in which speed reducing chamber walls 18 are spaced apart, at their upper end, from the inner wall surfaces of the inner box 2 to define therebetween auxiliary air ports 19, located near the upstream side of the secondary air ports 7, for issuing a secondary air of relatively low flow velocity. The speed reducing chamber walls 18 include upper end portions which are bent inwardly, at the auxiliary air ports 19, in a direction substantially perpendicular to the direction of flow of the mixture, so that the bent upper end portions of the walls 18 will function as flame stabilizing plates 20. The provision of the flame stabilizing plates 20 has the effect of reducing the flow rate of the mixture on the downstream side thereof and in the vicinity of the auxiliary air ports 19. Thus the flames adhering to the auxiliary air ports 19 have their stability increased, as explained by referring to the diagram shown in FIG. 1. A flame adhering to the secondary air ports 7 is protected by the stable flames adhering to the air ports 19, with the result that the stability of the flames is increased and the noise of combustion is reduced. In this embodiment, the combustion zone 5 and auxiliary air ports 8 are eliminated. However, the flames can be stabilized and the noise of combustion can be reduced for the reason stated hereinabove.

Figure 7:
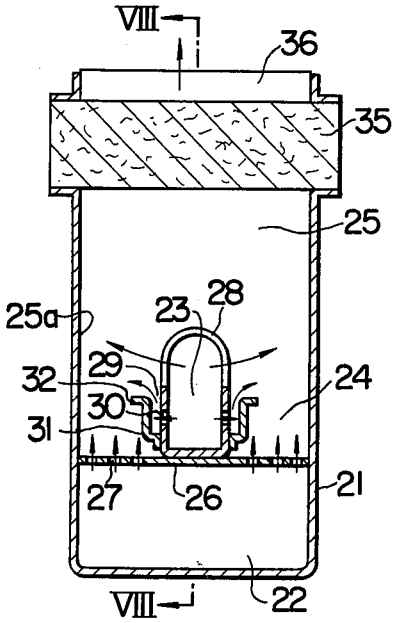
FIG. 7 is a sectional view of the burner comprising a sixth embodiment of the invention.
Figure 8:
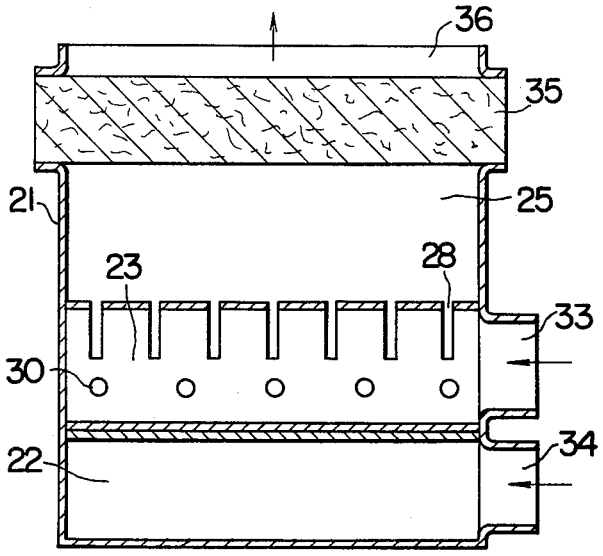
FIG. 8 is a sectional view taken along the line VIII—VIII in FIG. 7.

FIGS. 7 and 8 show a sixth embodiment of the invention which is formed at its central portion with an air passage and in which the mixture flows upwardly on the left and right sides of the passage. 21 designates a burner body defining a fuel chamber 22 on the upstream side of the interior of the body 21. The tubular secondary air passage 23 is provided on the downstream side of the fuel chamber 22, and a fuel passage 24 is formed on opposite sides of the secondary air passage 23. A combustion chamber 25 is formed on the downstream side of the passages 23 and 24. 26 designates a flame port plate formed therein with flame ports 27. 28 designates a plurality of secondary air issuing ports in the form of slits arranged in a row and opening in the fuel passage 24 on opposite sides thereof. The secondary air issuing slits 28 are shaped such that they are convexed toward the downstream side. The secondary air passage 23 is formed in its side walls with apertures 30 which are disposed in spaced juxtaposed relation to speed reducing plates 31. The speed reducing plates 31 and the walls of the secondary air passage 23 define therebetween auxiliary air slits 29 located on the upstream side of the slit-shaped secondary air ports 28. The apertures 30 have an area which is smaller than the area of the auxiliary air slits 29. Each of the speed reducing plates 31 has an upper end portion projecting toward the fuel passage 24 to serve as a flame stabilizing plate portion 32. 33 (FIG. 3) designates a secondary air inlet; 34, a mixture inlet; 35, a heat exchanger; and 36, an exhaust port.

In the construction described hereinabove, the mixture does not burn at flame ports 27 but flows to the fuel passage 24 on the downstream side thereof. Meanwhile a secondary air issues through the apertures 30, has its flow velocity reduced by the speed reducing plates 31, and issues through the auxiliary air slits 29 at a relatively low flow velocity. Thus a small flame is formed which is stable and adheres to the flame stabilizing plate portions 32. The heat end the intermediate products of combustion of the small flame are supplied to the vicinity of the secondary air issuing slits 28 disposed downstream of the apertures 30, so as to form a large flame which adheres to the vicinity of the secondary air issuing slits 28. A fuel and a secondary air issue through the secondary air issuing slits 28 in such a manner that the fuel is sandwiched by jet streams of the secondary air. Thus the secondary air and the fuel have a large area of contact with each other, and combustion takes place in all the contact surfaces of fuel and air, with the result that combustion takes place at a low noise and a high load. The gas produced by the combustion of fuel flows into the heat exchanger 35 where the gas gives off heat in heat exchange and is exhausted to atmosphere through the exhaust port 36.

Since the flame ports 27 are provided, a flame is formed such that it adheres to the flame ports 27 when the mixture falls within a flammable range due to the fact that the primary air volume increases or the fuel volume decreases for some reason. This prevents overheating of component parts of the fuel chamber 22 and secondary air passage 23, thereby ensuring combustion in a safe manner.

If no auxiliary air issuing slits 29 are provided, a flame would not adhere to the secondary air issuing slits 28 and a flame would be formed in a manner to float above the slits 28, when the secondary air issuing velocity through the secondary air issuing slits 28 becomes higher than 3 to 4 m/s. The portion in which combustion commences moves to the upstream side and downstream side with time, resulting in an increased noise of combustion. However, the provision of the auxiliary secondary air issuing slits 29 enables a small flame to burn stably because it adheres to the slits 29. Consequently, even if the velocity of the secondary air issuing through the secondary air slits 28 is over 10 m/s, it is possible to obtain a large flame which is stable and adheres to the secondary air issuing slits 28. However, when the secondary air issuing velocity became higher than about 12 m/s, turbulence of the jets of secondary air on the downstream side of the secondary air issuing slits 28 increased, with the result that combustion took place in turbulent flow of the mixture and the noise of combustion increased. Conversely, when the secondary air issuing velocity became lower than about 2 m/s, the secondary air did not reach walls 25*a* of the combustion chamber 25, and a flame extended to the downstream side near the walls 25*a*, so that it was impossible to carry out combustion at a high load. The aforesaid statement refers to the results of experiments conducted with a burner in which the combustion chamber 25 has a width of 60 mm between the walls 25*a*, by increasing the secondary air issuing velocity above 12 m/s and reducing the same below 2 m/s.

Preferably, the volume of secondary air issuing through the auxiliary secondary air slits 29 is in the range between 7 and 30% of the volume of secondary air issuing through the secondary air issuing slits 28. If the secondary air volume issuing through the slits 29 is smaller than this range of values, it is impossible to provide protection satisfactorily to a large flame adhering to the secondary air issuing slits 28, causing the noise of combustion to become larger. If it is greater than this range of values, it becomes impossible to carry out combustion at a high load because the volume of secondary air issuing through the slits 28 is reduced, thereby requiring a large volume of excess air.

In this embodiment, the flame stabilizing plate portions 32 are provided in the vicinity of the auxiliary secondary air issuing slits 29 as aforesaid. By virtue of this arrangement, the aforesaid small flame adheres to the downstream surface of each flame stabilizing plate portion 32 when the small flame adheres to the auxiliary air issuing slits 29. Therefore, the small flame is not affected by the flow of the fuel through the fuel passage 24 and is stable, even if the flow of the mixture increases its velocity. Owing to this phenomenon, a large flame adhering to the secondary air issuing slits 28 is also stabilized.

Now the results of experiments conducted on the sizes of various parts of the secondary air issuing slits 28 are described. The experiments were conducted by using a burner in which the distance (width in FIG. 7) between the walls 25*a* of the combustion chamber is 60 mm. The results of other experiments to be subsequently to be described were also carried out by using the same burner.

The pitch of the adjacent secondary air issuing slits 28 is advantageously in the range between 3 and 20 mm. When the pitch was smaller than this range of values, the jets of secondary air issuing through all the secondary air issuing slits 28 joined one another slightly downstream of the slits 28, and the mixture was forced to flow to the vicinity of the walls 25*a*, with the result that a flame extended toward the downstream side near the walls 25*a*, making it impossible to carry out combustion at a high load. Conversely, when the pitch was smaller than this range of values, it was impossible to supply the secondary air to the areas between the slits 28 in a volume sufficiently large to ensure complete combustion. The width of each slit 28 is advantageously in the range between 0.3 and 2.5 mm. When the width was smaller than this range of values, the secondary air could not reach the walls 25*a* of the combustion chamber 25 presumably because the secondary air was consumed by combustion before reaching the wall 25*a*. Thus, there was a shortage of secondary air near the walls 25*a* and a flame in this portion of the combustion chamber 25 extended toward the downstream side, making it impossible to carry out combustion at a high load. Conversely, when the width was larger than this range of values, the fuel did not mix with the central portion of the jets of secondary air. Stated differently, some portion of the secondary air did not take part in combustion, thereby requiring a large amount of excess air.

The jets of secondary air issuing through the secondary air issuing slits 28 will now be described. In this embodiment, a portion of the mixture is sucked toward the downstream side of the secondary air passage 23. Since the mixture is enriched beyond the flammability limit, it is necessary to supply a suitable amount of secondary air to the fuel passage 24 sides and the downstream side of the secondary air passage 23.

The cross sectional shape of the secondary air issuing slits 28 will now be described by referring to FIGS. 9 to 16. In all the examples shown, the initial velocity of secondary air was about 6 m/s.

Figure 9:
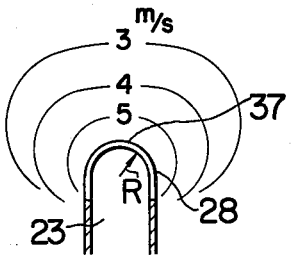
FIGS. 9 to 15 show the flow velocity distribution of the secondary air issuing from various types of secondary air ports.
Figure 10:
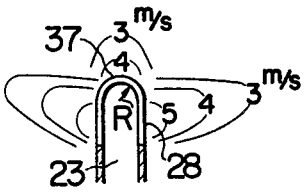

FIG. 9 shows the slit 28 which, in a cross sectional shape, is convex toward the downstream side of the flow of the mixture. The slit 28 has an upper end portion 37 which is in the form of a circular arc of a relatively large radius. The slit 28 shown in FIG. 10 has an upper end portion 37 which is in the form of a circular arc of a relatively small radius. The distribution of the jets of secondary air issuing through the slits 28 of the aforesaid cross sectional shape is such that, when the inside radius of the upper end portion 37 is below the range between 1.5 and 4 mm, the top and sides of the upper end portion 37 differs from each other in the flow velocity of secondary air issuing therethrough and the flow rate is lower at the top than at the side as shown in FIG. 10. When the inside radius of the upper end portion 37 is above the range between 1.5 and 4 mm, the flow velocity of secondary air issuing through the top and sides of the portion 37 is distributed uniformly as shown in FIG. 9. In the case of this embodiment in which the burner has a width of 60 mm, the inside radius of the upper end portion 37 of the secondary air issuing slit 28 is advantageously in the range between 1.5 and 15 mm. When the inside radius is below this range of values, there will occur a shortage of secondary air on the downstream side of the upper end portion 37. Thus incomplete combustion will take place, or soot will be produced when the fuel has a high carbon content. Conversely, when the inside diameter is above this range of values, the secondary air will be supplied to the downstream side of the upper end portion 37 in a volume greater than is necessary. Thus excess air will increase in quantity and the thermal efficiency of the heat exchanger 35 will be reduced.

Figure 11:
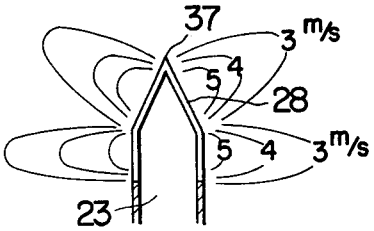

FIG. 11 shows the upper end portion 37 of the secondary air issuing slit 28 which consists of two inclined surfaces. When the portion 37 is shaped as shown, almost no secondary air flows to the downstream side of the upper end portion 37, causing a shortage of secondary air. This gives rise to incomplete combustion and the production of soot, in case the fuel has a high carbon content.

Figure 12:
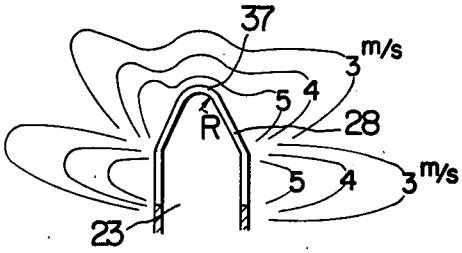

FIG. 12 shows an improvement in the upper end portion 37 shown in FIG. 11, in which the upper end portion 37 is formed by two inclined surfaces connected together by an arcuate tip. By connecting the upper end portions by means of an arcuate tip, it is possible to supply the secondary air to the downstream side of the upper end portion 37. For the same reason as stated by referring to FIGS. 9 and 10, the inside radius of the tip of the upper end portion 37 is advantageously in the range between 1.5 and 15 mm.

Figure 13:
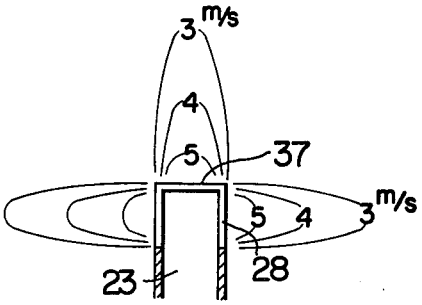

FIG. 13 shows the forward end portion 37 of the secondary air issuing slit 28 having the shape of a box. In this form of slit 28, a large volume of secondary air is supplied to the downstream side of the upper end portion 37 and excess air becomes large in volume. At the same time, the volume of secondary air issuing sideways of the upper end portion 37 is small, so that soot is produced when the fuel has a high content of carbon.

Figure 14:
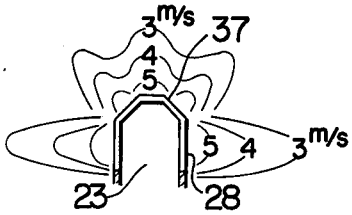

FIG. 14 shows an improvement in the upper end portion 37 shown in FIG. 13. The upper end portion 37 is shown in FIG. 14 has the shape of a polygon having three sides. The secondary air is supplied suitably from the upper end and the sides, enabling combustion to take place satisfactorily.

Figure 15:
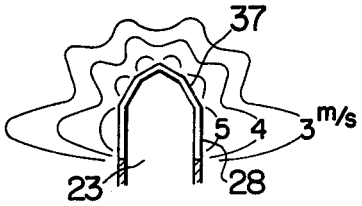

FIG. 15 shows an improvement in the upper end portion shown in FIG. 14. The upper end portion 37 shown in FIG. 15 has the shape of a polygon having four sides. The secondary air is supplied suitably from the upper end and the sides, enabling combustion to take place satisfactorily.

Figure 16:
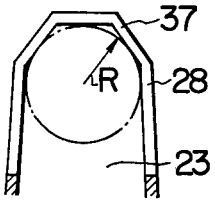
FIG. 16 is a view in explanation of the shape of the secondary air port.

FIG. 16 is a view in explanation of the upper end portions 37 of the polygonal shape shown in FIGS. 14 and 15. Each side of the upper end portion 37 of the polygonal shape is preferably arranged to be in contact with an imaginary circle of a radius in the range between 1.5 and 15 mm. If the upper end portion 37 of the polygonal shape does not meet this requirement, the burner will have the disadvantages of incomplete combustion of the fuel, the production of soot if the fuel is high in carbon content, and too much excess air, for the same reason as stated by referring to FIGS. 9 and 10.

When the upper end portion 37 of the arcuate shape is compared with the upper end portion 37 of the polyfonal shape, the former has the advantage of being easy to design because of paucity of parameters.

The data of one example of the invention will be described. The thermal load applied to the combustion chamber could be increased about ten fold or to $10^7$ kcal/h·m$^3$ or high load combustion took place without an attendant increase in the noise of combustion above the noise level of burners of the prior art, when the burner according to the invention had the following data: the width of the burner body 21, 60 mm; the radius of the upper end portion 37 of each secondary air issuing slit 28, 3 mm; the width of the slits 28, 0.6 mm; the pitch of the slits 28, 7 mm; and the secondary air issuing velocity through the slits 28, 6 m/s. Although the above descriptions are made with respect to the burner body having the width of 60 mm, they are applicable to burner bodies whose width is about 60 mm.

Figure 17:
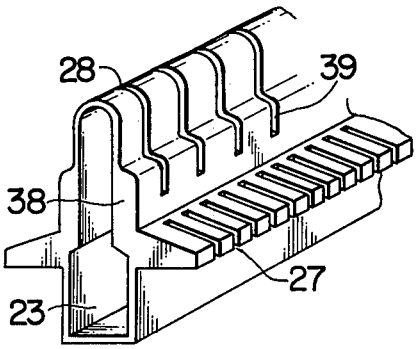
FIG. 17 is a perspective view of the secondary air ports and the flame port portion of a modified form.

FIG. 17 shows a modification of the embodiment in which the secondary air passage and the flame plate are formed integrally with each other. A formed material is machined to provide therein the secondary air issuing slits 28 and the flame ports 27.

The part in which the secondary air issuing slits 28 are formed has its thickness increased in a lower portion thereof at 38 to form therein auxiliary air ports 39 for issuing therethrough a secondary air of low flow velocity due to the resistance offered by the passage to the flow of the secondary air. Also, offset portions are formed in the increased thickness part 38 so as to form a stable small flame. By varying the thickness of the part 38 to provide a plurality of increased thickness parts, it is possible to provide a plurality of sets of auxiliary secondary air issuing ports which differ from one another in the secondary air issuing velocity. The pitch of the secondary air issuing slits 28 may be several times as large as that of the flame ports 27.

What is claimed is:

1. A burner comprising:

a combustion chamber;

air ports communicating with an air inlet and opening into said combustion chamber;

auxiliary air ports opening into said combustion chamber via an air speed reducing section communicating with said air inlet; and a fuel outlet communicating with supply means for supplying one of a gaseous fuel and a premix of a gaseous fuel and primary air in which the fuel is enriched above a flammability limit and opening into said combustion chamber;

wherein the improvement resides in the arrangement whereby:

said auxiliary air ports are located downstream of said fuel outlet with respect to the direction of flow of the fuel in said combustion chamber and said air ports are located further downstream of said auxiliary air ports, so that air is supplied through said auxiliary air ports at a relatively low flow velocity due to speed reduction in said speed reducing section and air is supplied through said air ports at a relatively high flow velocity.

2. A burner as claimed in claim 1, wherein the air issuing from the auxiliary air ports brings the air-fuel ratio of the fuel and the air in its vicinity to a combustible mixture range.

3. A burner as claimed in claim 1, wherein said auxiliary air ports are located relatively close to said air ports.

4. A burner as claimed in claim 3, wherein said one of fuel and its premix with the air in the vicinity of the auxiliary air ports has a flow velocity lower than the flow velocity thereof remote from the vicinity of the auxiliary air ports.

5. A burner as claimed in claim 4, wherein a passage for the stream of one of said gaseous fuel and said preformed mixture of fuel and primary air is widened and offset portions are formed therein in the vicinity of said air ports located on the upstream side for issuing the secondary air at a relatively low flow velocity.

6. A burner as claimed in claim 4, further comprising flame stabilizing means located in the vicinity of the auxiliary air ports on the upstream side of the combustion chamber and extending substantially perpendicularly to the issuing direction of the fuel.

7. A burner comprising:

a combustion chamber;

a fuel outlet communicating with supply means for supplying one of a gaseous fuel and a premix of a gaseous fuel and primary air in which the fuel is enriched above a flammability limit and opening in said combustion chamber; and an air passage extending through a fuel passage between said supply means and said fuel outlet and having at one end thereof secondary air ports and at the other end thereof air ports and auxiliary air ports opening into a combustion chamber;

wherein said fuel passage and said air passage are continuous in a right-angled direction with respect to the issuing direction, said air ports are in the form of slits opening from opposite sides of said air passage to the downstream end thereof in said combustion chamber with respect to the fuel issuing direction, said slits being large in number and disposed in side-by-side relation in the direction of continuation of said air passage, jets of air ejected from said air ports are distributed in such a manner that they are substantially uniform from the upstream end to the downstream end of the flow of the fuel to supply secondary air at a relatively high flow velocity, and said auxiliary air ports are located downstream of said fuel outlet and upstream of said air ports with respect to the issuing direction of the fuel and connected to said air passage through an air speed reducing section to supply air at a relatively low flow velocity due to its flowing through the air speed reducing section.

8. A burner as claimed in claim 7, wherein said air passage has one of an inner surface formed in an arcuate shape and an arcuate shape at its downstream end at which the air ports are located.

9. A burner comprising:

a combustion chamber;

an air inlet, a fuel outlet communicating with supply means for supplying one of a gaseous fuel and a premix of a gaseous fuel and primary air in which the fuel is enriched above a flammability limit and opening into said combustion chamber;

the improvement comprising first means for supplying first air at a first velocity from said air inlet to said combustion chamber upstream with respect to the direction of fuel flow in said combustion chamber, second means for supplying second air at a second velocity greater than said first velocity to said combustion chamber downstream with respect to said first air.

10. A burner as claimed in claim 9, further comprising:

flame stabilizing means located in the vicinity of said first means and extending substantially perpendicularly to the issuing direction of fuel flow.

11. A burner for burning a gaseous fuel in diffusion combustion or a performed mixture of fuel is enriched over and above a flammability limit, comprising:

air ports for issuing a secondary air at a relatively high flow velocity; and air ports for issuing a secondary air at a relatively low flow velocity located upstream of said air ports for issuing the secondary air at a relatively high flow velocity with respect to the direction of flow of a stream of one of said gaseous fuel and said performed mixture of fuel and primary air, a passage for one of said gaseous fuel and said performed mixture of fuel and primary air, and a secondary air passage located in the middle of and along said first mentioned passage, and wherein said air ports for issuing the secondary air at a relatively high flow velocity are in the form of slits and a plurality of said secondary air issuing slits are formed in said secondary air passage continuously in side-by-side relation in a manner to open from the surface of said passage for one of said gaseous fuel and said performed mixture toward the downstream side of a stream of one of said gaseous fuel and said performed mixture, whereby the jets of the secondary air issuing through said secondary air issuing slits are distributed substantially evenly in a region extending from lateral sides of the passage to the downstream side thereof.

12. A burner as claimed in claim 11, wherein the secondary air issuing slits are each formed, at the inner surface of an upper end portion thereof located on the downstream side, in the shape of an arc or an arcuate polygon.

13. A burner as claimed in claim 11 or 7, wherein said passage for the secondary air has increased thickness portions on the upstream side thereof, said passage for one of said gaseous fuel and said preformed mixture of fuel and primary air is formed with offset portions to widen the passage for one of said gaseous fuel and said preformed mixture, and said increased thickness portions are formed therein with slits continuous with said secondary air issuing slits located downstream thereof.

* * * * *